US008524430B2

(12) United States Patent
Takagi et al.

(10) Patent No.: US 8,524,430 B2
(45) Date of Patent: Sep. 3, 2013

(54) ELECTROPHOTOGRAPHIC PHOTOSENSITIVE MEMBER, PROCESS CARTRIDGE, AND ELECTROPHOTOGRAPHIC APPARATUS

(75) Inventors: Shinji Takagi, Mishima (JP); Hideaki Nagasaka, Suntou-gun (JP); Kunihiko Sekido, Numazu (JP); Michiyo Sekiya, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 557 days.

(21) Appl. No.: 12/625,821

(22) Filed: Nov. 25, 2009

(65) Prior Publication Data

US 2011/0104601 A1 May 5, 2011

(30) Foreign Application Priority Data

Nov. 2, 2009 (JP) ..... 2009-252119

(51) Int. Cl.
*G03G 5/14* (2006.01)

(52) U.S. Cl.
USPC ..... 430/63; 430/62; 430/131; 399/159

(58) Field of Classification Search
USPC ..... 430/60, 62, 63, 131; 399/159
See application file for complete search history.

(56) References Cited

U.S. PATENT DOCUMENTS

| | | | | |
|---|---|---|---|---|
| 3,745,005 | A * | 7/1973 | Yoerger et al. | 430/63 |
| 4,379,822 | A * | 4/1983 | Shaw | 430/62 |
| 4,535,045 | A * | 8/1985 | Kawamura et al. | 430/60 |
| 4,557,856 | A * | 12/1985 | Miyakawa et al. | 252/500 |
| 4,579,801 | A | 4/1986 | Yashiki | |
| 4,933,246 | A * | 6/1990 | Teuscher | 430/64 |
| 5,013,625 | A * | 5/1991 | Takizawa et al. | 430/64 |
| 5,154,996 | A * | 10/1992 | Makino et al. | 430/59.6 |
| 5,368,995 | A | 11/1994 | Christian et al. | |
| 5,714,248 | A * | 2/1998 | Lewis | 428/325 |
| 6,312,858 | B1 * | 11/2001 | Yacobucci et al. | 430/17 |
| 6,750,288 | B2 | 6/2004 | Pradel | 525/100 |
| 6,831,131 | B2 | 12/2004 | Bouilloux et al. | 525/191 |
| 6,890,661 | B2 | 5/2005 | Pradel | 428/446 |
| 7,396,622 | B2 | 7/2008 | Nagasaka et al. | |
| 7,534,537 | B2 * | 5/2009 | Miki et al. | 430/63 |
| 7,732,113 | B2 * | 6/2010 | Nakamura et al. | 430/63 |
| 2003/0040579 | A1 | 2/2003 | Pradel | 525/191 |
| 2003/0187128 | A1 | 10/2003 | Shiba et al. | 524/556 |
| 2004/0259009 | A1 | 12/2004 | Itami et al. | 430/60 |
| 2011/0104599 | A1 * | 5/2011 | Nagasaka et al. | 430/56 |

FOREIGN PATENT DOCUMENTS

| | | | |
|---|---|---|---|
| JP | 44006394 | * | 1/1969 |
| JP | 01277248 | A * | 11/1989 |
| JP | 01289966 | A * | 11/1989 |
| JP | 02212853 | A * | 8/1990 |

(Continued)

OTHER PUBLICATIONS

Search Report dated Jan. 28, 2011 in European Application No. 09177198.0.

*Primary Examiner* — Christopher Rodee
(74) *Attorney, Agent, or Firm* — Fitzpatrick, Cella, Harper & Scinto

(57) ABSTRACT

The present invention relates to an electrophotographic photosensitive member obtained by providing, on a conductive support, a conductive layer containing conductive particles having a volume-average particle diameter of 0.1 μm or more, an intermediate layer, and a photosensitive layer in the stated order in which the conductive layer contains a polyolefin resin containing a specific repeating structural unit at a specific ratio, and a process cartridge and an electrophotographic apparatus each having the electrophotographic photosensitive member.

6 Claims, 2 Drawing Sheets

(56) References Cited

FOREIGN PATENT DOCUMENTS

| | | |
|---|---|---|
| JP | 2003-105145 | 4/2003 |
| JP | 2003-119328 | 4/2003 |
| JP | 2003-147028 | 5/2003 |
| JP | 2003-268164 | 9/2003 |
| JP | 2004-077976 | 3/2004 |
| JP | 2005-010591 | 1/2005 |
| JP | 2005-017470 | 1/2005 |
| WO | WO 2006104225 A2 * | 10/2006 |

* cited by examiner

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

1. Field of the Invention

The present invention relates to an electrophotographic photosensitive member, a process cartridge, and an electrophotographic apparatus.

2. Description of the Related Art

Electrophotographic photosensitive members are each requested to provide sensitivity, electrical characteristics, optical characteristics, and a high-quality image free of image defects in accordance with an electrophotographic process to which the electrophotographic photosensitive member is applied. Representative examples of the image defects include image stripes, black dots in a white portion, white dots in a black portion, and ground fogging in the white portion. Further, when any one of the electrophotographic photosensitive members is exposed to light by using the laser diode of a digital copying machine or laser beam printer as a light source, interference fringes that occur owing to the surface profile of the support of the photosensitive member or the non-uniformity of the thickness of the photosensitive member are also included in the examples. A method of suppressing the image defects is, for example, to provide a layer between the photosensitive layer and support of any one of the electrophotographic photosensitive members. The layer between the photosensitive layer and the support is requested to have an electrical blocking function by which the injection of charge from the support is prevented when a voltage is applied to the electrophotographic photosensitive member. This is because of the following reason: the injection of charge from the support is responsible for a reduction in charging performance of the electrophotographic photosensitive member, a reduction in contrast of an image, and, in the case of a reversal developing system, black dots and ground fogging in a white portion described above, thereby reducing the quality of the image.

On the other hand, when the electrical resistance of the layer between the photosensitive layer and the support is excessively high, charge generated in the photosensitive layer resides in the photosensitive layer, thereby causing an increase in residual potential of the electrophotographic photosensitive member or a fluctuation in potential of the electrophotographic photosensitive member due to its repeated use. Therefore, not only the electrical blocking function but also some degree of reduction in electrical resistance of the layer between the photosensitive layer and the support is needed. A method of reducing the electrical resistance of the layer between the photosensitive layer and the support is, for example, to disperse a metal oxide in the layer. The layer between the photosensitive layer and the support disclosed in each of Japanese Patent Application Laid-Open No. 2004-077976, Japanese Patent Application Laid-Open No. 2005-010591, and Japanese Patent Application Laid-Open No. 2005-017470 has the following characteristics: anatase type titanium oxide is incorporated into the layer to reduce the resistance of the layer so that the layer may secure conductivity, and the layer has the electrical blocking function.

However, the layer between the support and the photosensitive layer may be requested to have a hiding function of hiding the defects of the support as well as the conductivity and an electrical barrier characteristic. One known approach to achieving those characteristics is a laminate type layer obtained by: providing a thick layer containing a conductive material on the support; and providing a thin resin layer having the electrical blocking function and free of any conductive material on the thick layer.

In general, the above layer containing a conductive material in the laminate type layer between the photosensitive layer and the support is called a conductive layer, and the layer free of any conductive material in the layer is called an intermediate layer, an undercoating layer, or a barrier layer. A thermosetting resin such as a phenol resin, a polyurethane resin, an epoxy resin, an acrylic resin, or a melamine resin is used in the conductive layer. Investigations were conducted on the use of a polyolefin resin excellent in dielectric characteristic as another resin for use in the conductive layer. However, the polyolefin resin shows poor solubility, and it is not easy to prepare a stable application liquid for the conductive layer, so it has been difficult to use the polyolefin resin as a resin for the conductive layer.

In addition, electrophotographic apparatuses each adopting the following contact charging system have become widespread: a voltage is applied to a charging member (contact charging member) placed to contact an electrophotographic photosensitive member so that the electrophotographic photosensitive member may be charged. Of such systems as described above, the following system is an AC/DC contact charging system: a roller-shaped contact charging member is brought into contact with the surface of the electrophotographic photosensitive member, and a voltage obtained by superimposing an AC voltage on a DC voltage is applied to the member so that the electrophotographic photosensitive member may be charged. In addition, out of such systems as described above, the following system is a DC contact charging system: a voltage formed only of a DC voltage is applied to a contact charging member so that the electrophotographic photosensitive member may be charged.

However, any such contact charging system as described above involves, for example, the following problems: the non-uniformity of charging and the occurrence of the discharge breakdown of the photosensitive member due to direct application of a voltage. The non-uniformity of charging becomes remarkable particularly in the DC contact charging system. The non-uniformity of charging is as follows: portions on the surface of the photosensitive member are not uniformly charged, so stripe-like charging non-uniformity (charging stripes) arises in the direction perpendicular to the direction in which the surface to be charged moves.

SUMMARY OF THE INVENTION

The present invention provides an electrophotographic photosensitive member having a conductive layer showing the following characteristics, and a process cartridge and an electrophotographic apparatus each including the electrophotographic photosensitive member: even when the electrophotographic photosensitive member is used in the above DC contact charging system, the conductive layer suppresses image defects resulting from charging non-uniformity, and is in an excellent film state.

According to the present invention, there are provided the following electrophotographic photosensitive member, process cartridge, and electrophotographic apparatus:

an electrophotographic photosensitive member, including: a conductive support; a conductive layer containing conductive particles having a volume-average particle diameter of 0.1 μm or more; an intermediate layer; and a photosensitive layer, the conductive layer, the intermediate layer, and the photosensitive layer being provided on the conductive support in the stated order, in which the conductive layer contains a polyolefin resin having the following repeating structural units (A1), (A2), and (A3), and the mass ratio (%) of the units (A1), (A2), and (A3) in the polyolefin resin satisfies the following formula (1):

$$0.01 \leqq (A2)/\{(A1)+(A2)+(A3)\} \times 100 \leqq 30 \quad \text{Formula (1)}$$

(A1): a repeating structural unit represented by the following formula (11):

(11)

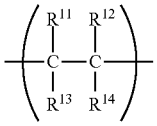

where $R^{11}$ to $R^{14}$ each independently represent a hydrogen atom or an alkyl group;

(A2): a repeating structural unit represented by one of the following formulae (21) and (22):

(21)

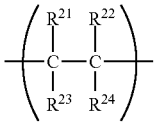

(22)

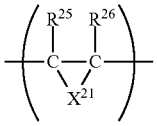

where $R^{21}$ to $R^{24}$ each independently represent a hydrogen atom, an alkyl group, a phenyl group, or a monovalent group represented by —$Y^{21}$COOH where $Y^{21}$ represents a single bond, an alkylene group, or an arylene group, $R^{25}$ and $R^{26}$ each independently represent a hydrogen atom, an alkyl group, or a phenyl group, and $X^{21}$ represents a divalent group represented by —$Y^{22}$COOCO$Y^{23}$— where $Y^{22}$ and $Y^{23}$ each independently represent a single bond, an alkylene group, or an arylene group, provided that at least one of $R^{21}$ to $R^{24}$ represents a monovalent group represented by —$Y^{21}$COOH; and (A3): a repeating structural unit represented by any one of the following formulae (31), (32), (33), and (34):

(31)

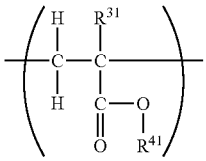

(32)

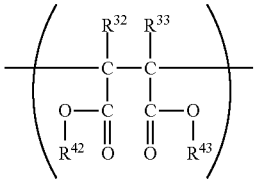

-continued (33)

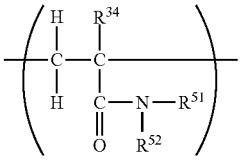

(34)

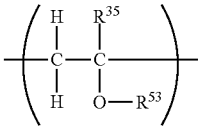

where $R^{31}$ to $R^{35}$ each independently represent a hydrogen atom or a methyl group, $R^{41}$ to $R^{43}$ each independently represent an alkyl group having 1 to 10 carbon atoms, and $R^{51}$ to $R^{53}$ each independently represent a hydrogen atom or an alkyl group having 1 to 10 carbon atoms;

a process cartridge, including: the electrophotographic photosensitive member; and at least one device selected from the group consisting of a charging device that charges the electrophotographic photosensitive member, a developing device that develops an electrostatic latent image formed on the electrophotographic photosensitive member with toner to form a toner image, and a cleaning device that recovers the toner remaining on the electrophotographic photosensitive member after transfer of the toner image onto a transfer material, in which the process cartridge, integrally supports the electrophotographic photosensitive member and the at least one device, and is detachable from a main body of an electrophotographic apparatus; and an electrophotographic apparatus, including: the electrophotographic photosensitive member; a charging device that charges the electrophotographic photosensitive member; an exposing device that exposes the charged electrophotographic photosensitive member to light to form an electrostatic latent image on the electrophotographic photosensitive member; a developing device that develops the electrostatic latent image formed on the electrophotographic photosensitive member with toner to form a toner image; and a transferring device that transfers the toner image on the electrophotographic photosensitive member onto a transfer material.

According to the present invention, there can be provided an electrophotographic photosensitive member having a conductive layer showing the following characteristics, and a process cartridge and an electrophotographic apparatus each including the electrophotographic photosensitive member: the conductive layer suppresses image defects resulting from charging non-uniformity, and is in an extremely excellent film state.

Further features of the present invention will become apparent from the following description of exemplary embodiments with reference to the attached drawings.

DESCRIPTION OF THE EMBODIMENTS

Figure 1:
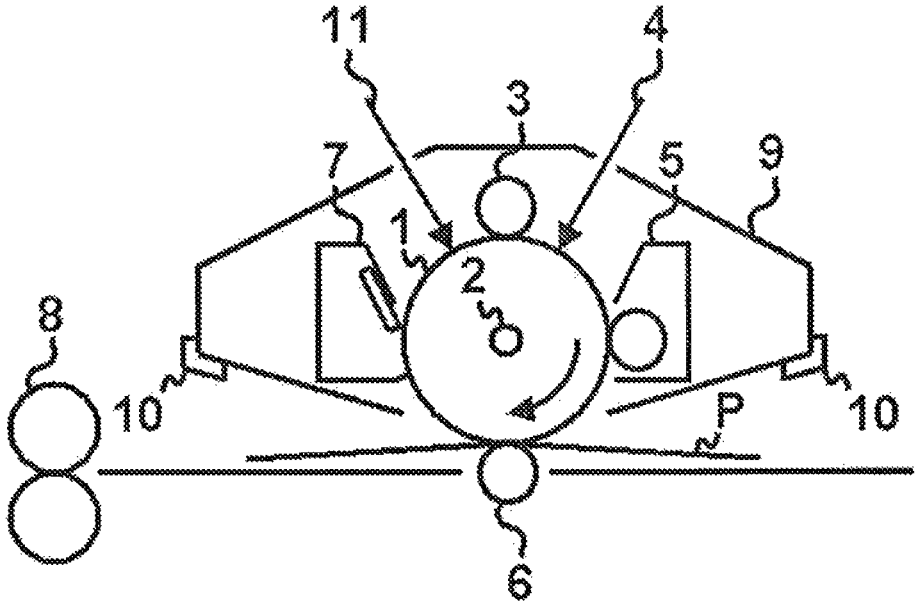
FIG. 1 is a view illustrating an example of the outline constitution of an electrophotographic apparatus including a process cartridge having an electrophotographic photosensitive member of the present invention.

An electrophotographic photosensitive member of the present invention is an electrophotographic photosensitive member obtained by providing, on a conductive support, a conductive layer, an intermediate layer, and a photosensitive layer in the stated order. In addition, the conductive layer contains conductive particles having a volume-average particle diameter of 0.1 μm or more and a polyolefin resin having a specific structure.

The polyolefin resin used in the present invention has the above repeating structural units (A1), (A2), and (A3), and the mass ratio (%) of the units (A1), (A2), and (A3) satisfies the following formula (1):

$$0.01 \leqq (A2)/\{(A1)+(A2)+(A3)\}\times 100 \leqq 30 \qquad \text{Formula (1).}$$

The above formula (1) represents the mass ratio of the unit (A2) to the total amount of the units (A1) to (A3). When the mass ratio (%) of the unit (A2) is less than 0.01 mass %, a conductive layer formed by applying an application liquid for the conductive layer containing the polyolefin resin onto the conductive support peels off the conductive support, so it becomes difficult to obtain a good conductive layer. On the other hand, when the mass ratio (%) of the unit (A2) is larger than 30 mass %, a change in dielectric characteristic of the electrophotographic photosensitive member resulting from the conductive layer occurs, and, if a combination of the electrophotographic photosensitive member and the above-mentioned DC charging apparatus is used in an electrophotographic process, a striped image originating from charging non-uniformity is apt to be produced.

The unit (A2) of the polyolefin resin may have one of or both of a carboxylic acid group and a carboxylic acid anhydride group. Examples of a monomer for constituting the unit (A2) having at least one of a carboxylic acid group and a carboxylic acid anhydride group include acrylic acid, methacrylic acid, maleic acid, maleic anhydride, itaconic acid, itaconic anhydride, fumaric acid, and crotonic acid, and half esters and half amides of unsaturated dicarboxylic acids.

Of those, acrylic acid, methacrylic acid, maleic acid, and maleic anhydride are preferable, and acrylic acid and maleic anhydride are particularly preferable. The unit (A2) having at least one of a carboxylic acid group and a carboxylic acid anhydride group exists as a copolymer in the polyolefin resin. Further, the form of the copolymer is not particularly limited and may include random copolymers, block copolymers, and graft copolymers.

Accordingly, in the formula (21) representing the unit (A2), it is preferred that $R^{21}$ to $R^{29}$ each independently represent a hydrogen atom, an alkyl group having 1 to 7 carbon atoms, a phenyl group, or a monovalent group represented by —$Y^{21}$COOH where $Y^{21}$ represents a single bond, an alkylene group having 1 to 7 carbon atoms, or an arylene group, and at least one of $R^{21}$ to $R^{24}$ represent a monovalent group represented by —$Y^{21}$COOH; it is more preferred that three of $R^{21}$ to $R^{24}$ each represent a hydrogen atom and the remaining one represent —COOH, two of $R^{21}$ to $R^{24}$ each represent a hydrogen atom, one of them represent a methyl group, and the remaining one represent —COOH, and two of $R^{21}$ to $R^{24}$ each represent a hydrogen atom and the remaining two each represent —COOH.

In addition, in the formula (22) representing the unit (A2), it is preferred that $R^{25}$ and $R^{26}$ each independently represent a hydrogen atom, an alkyl group having 1 to 7 carbon atoms, or a phenyl group, and $X^{21}$ represent a divalent group represented by —$Y^{22}$COOCO$Y^{23}$— where $Y^{22}$ and $Y^{23}$ each independently represent a single bond, an alkylene group having 1 to 7 carbon atoms, or an arylene group; it is more preferred that $R^{25}$ and $R^{26}$ each represent a hydrogen atom and $X^{21}$ represent —COOCO—.

It should be noted that the unsaturated carboxylic anhydride such as maleic anhydride is as follows: when the resin is in a dry state, carboxyl groups adjacent to each other undergo cyclodehydration to form an acid anhydride structure. However, in, for example, an aqueous medium containing a basic compound, part or all of the molecules of the unsaturated carboxylic anhydride undergo ring-opening so that the molecules may tend to adopt the structure of a carboxylic acid or a salt of the acid. In addition, when the amount of the compound having a carboxylic acid group or carboxylic anhydride group is calculated with reference to the amount of the carboxyl groups of the resin in the present invention, the calculation is performed on the assumption that all carboxylic anhydride groups in the resin undergo ring-opening to form carboxyl groups.

In addition, the polyolefin resin used in the present invention more preferably has the mass ratio (%) of the units (A1), (A2), and (A3) satisfying the following formulae (2) and (3):

$$0.01 \leqq (A2)/\{(A1)+(A2)+(A3)\}\times 100\times 10 \qquad \text{Formula (2); and}$$

$$(A1)/(A3)=55/45 \text{ to } 99/1 \qquad \text{Formula (3).}$$

In addition, it is more preferable that the mass ratio (%) of the units (A1), (A2), and (A3) satisfy the following formula (4):

$$0.01 \leqq (A2)/\{(A1)+(A2)+(A3)\}\times 100 \leqq 5 \qquad \text{Formula (4).}$$

It is preferable that the polyolefin resin satisfies the above formulae (2) and (3) because the effect of the present invention is improved. Further, it is more preferable to satisfy the above formula (4) because the effect of the present invention is further improved.

In addition, the above ratio (A1)/(A3) more preferably satisfies the relationship of $60/39 \leqq (A1)/(A3) \leqq 93/1$ because the effect of the present invention is improved. It should be noted that the total mass ratio (%) of the above units (A1), (A2), and (A3) in the above polyolefin resin is preferably 90% to 100% in order that the effect of the present invention may not be inhibited by an influence of any other component in the polyolefin resin.

Examples of monomers for constituting the unit (A1) include alkenes such as ethylene, propylene, isobutylene, 1-butene, 1-pentene, and 1-hexene. The polyolefin resin contains the unit (A1) as a copolymer obtained by copolymerizing those monomers. The alkenes may be used alone or in combination. Of those, alkenes having 2 to 4 carbon atoms, such as ethylene, propylene, isobutylene, and 1-butene are more preferable, and ethylene is particularly preferable.

Accordingly, $R^{11}$ to $R^{14}$ in the formula (11) representing the unit (A1) each independently represent preferably a hydrogen atom or an alkyl group having 1 to 5 carbon atoms, and all of $R^{11}$ to $R^{14}$ are more preferably a hydrogen atom.

In addition, a monomer for constituting the above unit (A3) is, for example, any one of the following compounds. In addition, the polyolefin resin contains the unit (A3) as a copolymer obtained by copolymerizing those monomers.

Formula (31): (meth)acrylates such as methyl (meth)acrylate, ethyl (meth)acrylate, and butyl(meth)acrylate.

Formula (32): maleates such as dimethyl maleate, diethyl maleate, and dibutyl maleate.

Formula (33): (meth)acrylic acid amides.

Formula (34): alkyl vinyl ethers such as methyl vinyl ether and ethyl vinyl ether, and vinyl alcohols obtained by saponifying vinyl esters with basic compounds.

One kind of those monomers may be used alone, or two or more kinds of them may be used as a mixture. Of those, the (meth)acrylates represented by the formula (31) are more preferable, and methyl (meth) acrylate or ethyl (meth) acrylate is particularly preferable.

In the formulae (31) to (34), $R^{31}$ to $R^{35}$ each independently represent a hydrogen atom or a methyl group, $R^{41}$ to $R^{43}$ each independently represent an alkyl group having 1 to 10 carbon atoms, and $R^{51}$ to $R^{53}$ each independently represent a hydrogen atom or an alkyl group having 1 to 10 carbon atoms; in view of the foregoing, it is more preferred that the above unit (A3) be represented by the formula (31) where $R^{41}$ represents a methyl group or an ethyl group.

In the present invention, the above polyolefin resin particularly preferably contains a ternary copolymer obtained by copolymerizing ethylene, methyl (meth) acrylate or ethyl (meth)acrylate, and maleic anhydride as monomers. Specific examples of the ternary copolymer include an ethylene-acrylate-maleic anhydride ternary copolymer and an ethylene-methacrylate-maleic anhydride ternary copolymer. In some cases, only a small part of the ester bonds of the acrylate structural units are hydrolyzed when the resin is made aqueous so that the structural units may be turned into acrylic acid structural units; in such cases, the ratios of the respective structural units taking those changes into consideration have only to fall within specified ranges.

The polyolefin resin used in the present invention may contain a component other than the units (A1) to (A3) described above as a component of the copolymer to such an extent that the effect of the present invention is not impaired. Specific examples of a monomer for constituting a component other than the units (A1) to (A3) include dienes, (meth) acrylonitrile, vinyl halides, vinylidene halides, carbon monoxide, and carbon disulfide.

Although the molecular weight of the polyolefin resin used in the present invention is not particularly limited, a resin having a molecular weight of 10,000 to 50,000 is generally used, and a resin having a molecular weight of 20,000 to 30,000 is preferably used. A method of synthesizing the polyolefin resin is not particularly limited either. The above polyolefin resin can be obtained by, for example, subjecting monomers for constituting the polyolefin resin to high-pressure radical copolymerization in the presence of a radical generator.

The above polyolefin resin is preferably dispersed or dissolved in an aqueous medium. Here, the aqueous medium is a medium formed of a liquid mainly formed of water, and may contain a water-soluble organic solvent. Examples of the organic solvent include alcohols such as methanol, ethanol, and isopropanol. The content of the organic solvent in the aqueous medium is preferably 10 to 40 mass %.

The conductive layer used in the present invention contains conductive particles having a volume-average particle diameter of 0.1 μm or more. Carbon black, metal particles, or metal oxide particles can be used as the conductive particles; a conductive metal oxide such as zinc oxide, titanium oxide, or tin oxide is preferably used in each of the conductive particles, and a metal oxide of such a type that titanium oxide is coated with oxygen defective tin oxide is more preferably used in each of the conductive particles. When the volume-average particle diameter of the conductive particles is less than 0.1 μm, the resistance of the conductive layer increases, so a striped image originating from charging non-uniformity is apt to be produced. Accordingly, the effect of the present invention is not exerted. In addition, the volume-average particle diameter of the above conductive particles is preferably 0.1 to 1.0 μm, or more preferably 0.1 to 0.6 μm. Further, the mass ratio of the above conductive particles in the conductive layer is preferably 50 to 80 mass %, or more preferably 67 to 75 mass %. In addition, the mass ratio (%) of the above polyolefin resin in the conductive layer is preferably 20% to 50%.

In the present invention, a method of measuring the above volume-average particle diameter is as described below.

The volume-average particle diameter of an application liquid for the conductive layer having such composition that only the conductive particles were dispersed in the liquid was measured by a liquid phase sedimentation method. To be specific, the application liquid for the conductive layer was diluted with the solvent used in the liquid, and the volume-average particle diameter of the diluted liquid was measured with an ultracentrifugal automatic particle size distribution-measuring apparatus (CAPA700) manufactured by HORIBA, Ltd.

In the present invention, the application liquid for the conductive layer is obtained by: subjecting the above conductive particles to a dispersion treatment together with the following organic solvent; mixing the resultant dispersion liquid with the above polyolefin resin aqueous dispersion; and stirring the mixture. Then, the conductive layer is formed by: applying the application liquid for the conductive layer obtained by the foregoing method onto the conductive support; and drying the applied liquid.

Examples of the dispersion method for the conductive particles include methods employing a paint shaker, a sand mill, a ball mill, a liquid collision-type high-speed dispersing unit, or the like.

Examples of the organic solvents to be used in the application liquid for the conductive layer include alcohols such as methanol, ethanol, and isopropanol; ketones such as acetone, methyl ethyl ketone, and cyclohexanone; ethers such as tetrahydrofuran, dioxane, ethylene glycol monomethyl ether, and propylene glycol monomethyl ether; esters such as methyl acetate and ethyl acetate; and aromatic hydrocarbons such as toluene and xylene.

As described above, in the present invention, the application liquid for the conductive layer is prepared by mixing the conductive particles dispersed with the organic solvent and the polyolefin resin. With regard to the amount of the organic solvent in the application liquid for the conductive layer, the stability of the aqueous dispersion may reduce depending on the kind of the organic solvent to be used, so the organic solvent must be incorporated to such an extent that the stability does not reduce. In other words, the solid content of the dispersion liquid obtained by subjecting the conductive particles to a dispersion treatment, the solid content of, and mixing ratio of the organic solvent in, the polyolefin resin aqueous dispersion, and the mixing ratio of the dispersion liquid and the dispersion are selected in consideration of: the viscosity of the application liquid taking the thickness of the conductive layer to be applied into consideration; and the stability of the dispersion.

A curable resin such as a phenol resin or a polyurethane resin as well as the above polyolefin resin can be mixed into the conductive layer to such an extent that the characteristics of the conductive layer are satisfied. Alternatively, a surface roughness-imparting agent for roughening the surface of the conductive layer can be added to the conductive layer in order that the following phenomenon may be suppressed: light beams reflected at the surface of the conductive layer interfere with each other to cause interference fringes on an output image.

The surface roughness-imparting agent is preferably resin particles having an average particle diameter of 1 to 6 μm.

Examples of the resin particles include particles each formed of curable rubber or of a curable resin such as a polyurethane resin, an epoxy resin, an alkyd resin, a phenol resin, a polyester resin, a silicone resin, or an acrylic-melamine resin. Of those, particles each formed of the silicone resin which hardly aggregate are preferable. In addition, a known leveling agent may be added for improving the surface characteristic of the conductive layer.

In addition, the thickness of the conductive layer is preferably 10 to 35 μm, or more preferably 15 to 30 μm from the following viewpoint: the surface defects of the conductive support should be hidden. It should be noted that the thicknesses of the respective layers of the electrophotographic photosensitive member including the conductive layer in the present invention were each measured with a FISHERSCOPE mms manufactured by Fischer Instruments K.K.

In the present invention, the intermediate layer having an electrical barrier characteristic must be provided between the conductive layer and the photosensitive layer for inhibiting the injection of charge from the conductive layer into the photosensitive layer. The volume resistivity of the intermediate layer is preferably $1\times10^{9}$ to $1\times10^{13}$ Ωcm. When the volume resistivity of the intermediate layer is excessively small, the intermediate layer shows a poor electrical barrier characteristic, so the occurrence of spots and fogging resulting from the injection of charge from the conductive layer tends to be remarkable. On the other hand, when the volume resistivity of the intermediate layer is excessively large, the flow of charge (carrier) at the time of the formation of an image becomes sluggish, so an increase in residual potential of the electrophotographic photosensitive member (lack of the stability of the potential of the electrophotographic photosensitive member) tends to be remarkable. The thickness of the intermediate layer is preferably 0.05 to 10 μm, or particularly preferably 0.3 to 5 μm. It should be noted that a known constitution and a known production method can be used as the constitution of, and a production method for, the intermediate layer with reference to the above parameters.

The electrophotographic photosensitive member of the present invention has the photosensitive layer provided on the above intermediate layer. The above photosensitive layer is not particularly limited, and may be a single-layer type photosensitive layer containing a charge-transporting substance and a charge-generating substance in the same layer, or may be a laminate type (separated-function type) photosensitive layer separated into a charge generation layer containing the charge-generating substance and a charge transport layer containing the charge-transporting substance; the laminate type photosensitive layer is preferable from the viewpoint of the electrophotographic characteristics of the electrophotographic photosensitive member. In addition, the kinds of the laminate type photosensitive layer are classified into a forward photosensitive layer obtained by laminating the charge generation layer and the charge transport layer in the stated order from the side of the conductive support and a reverse photosensitive layer obtained by laminating the charge transport layer and the charge generation layer in the stated order from the side of the conductive support; the forward photosensitive layer is preferable from the viewpoint of the electrophotographic characteristics.

Figure 2:
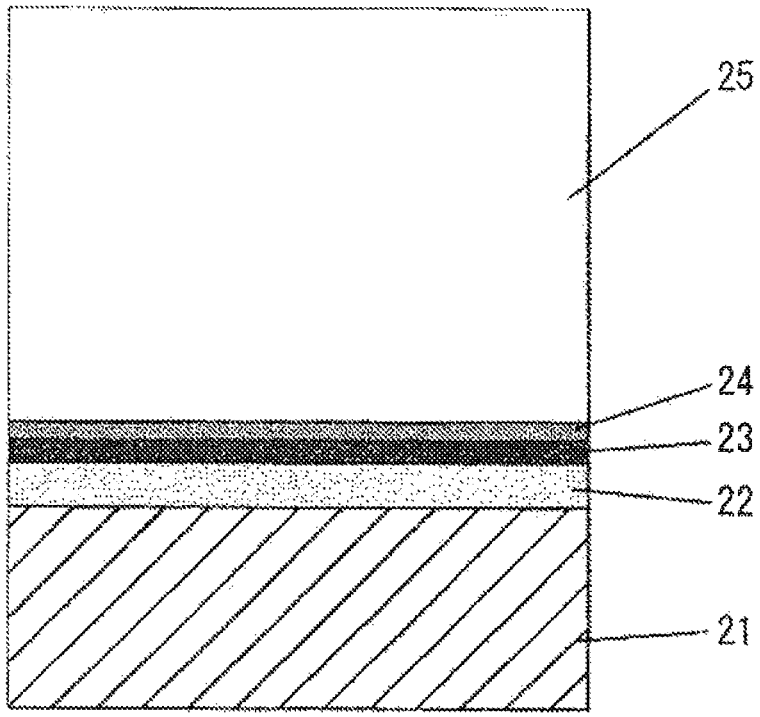
FIG. 2 is an outline view illustrating an example of the layer constitution of the electrophotographic photosensitive member of the present invention.

FIG. 2 illustrates the outline of a preferable constitution of the electrophotographic photosensitive member in the present invention. In the electrophotographic photosensitive member of FIG. 2, a conductive layer 22, an intermediate layer 23, and a charge generation layer 24 and a charge transport layer 25 to be described later are laminated on a conductive support 21.

A material for the above conductive support is not particularly limited as long as the material has conductivity, and a support made of a metal (alloy) such as aluminum, an aluminum alloy, or stainless steel can be used. In addition, the above support made of a metal having a layer onto which a coating film has been formed by the vacuum deposition of aluminum, an aluminum alloy, or an indium oxide-tin oxide alloy or a plastic support having such layer can also be used. In addition, for example, a support obtained by impregnating a plastic or paper with conductive particles such as carbon black, tin oxide particles, titanium oxide particles, and silver particles together with a proper binder resin, or a plastic support having a conductive binder resin can also be used.

Examples of the charge-generating substance to be used in the above charge generation layer include: azo pigments such as monoazo, disazo, and trisazo; phthalocyanine pigments such as metal phthalocyanine and non-metal phthalocyanine; indigo pigments such as indigo and thioindigo; perylene pigments such as perylenic anhydride and perylenic imide; polycyclic quinone pigments such as anthraquinone, pyrenequinone, and dibenzpyrenequinone; squarylium dyes; pyrylium salts and thiapyrylium salts; triphenylmethane dyes; inorganic substances such as selenium, selenium-tellurium, and amorphous silicon; quinacridone pigments; azulenium salt pigments; cyanine dyes such as quinocyanine; anthanthrone pigments; pyranthrone pigments; xanthene dyes; quinoneimine dyes; styryl dyes; cadmium sulfide; and zinc oxide. Those charge-generating substances may be used alone or two or more types may be used.

Examples of the binder resin to be used in the charge generation layer include an acrylic resin, an allyl resin, an alkyd resin, an epoxy resin, a diallyl phthalate resin, a silicone resin, a styrene-butadiene copolymer, a phenol resin, a butyral resin, a benzal resin, a polyacrylate resin, a polyacetal resin, a polyamide-imide resin, a polyamide resin, a polyaryl ether resin, a polyarylate resin, a polyimide resin, a polyurethane resin, a polyester resin, a polyethylene resin, a polycarbonate resin, a polystyrene resin, a polysulfone resin, a polyvinyl acetal resin, a polybutadiene resin, a polypropylene resin, a methacrylic resin, a urea resin, a vinyl chloride-vinyl acetate copolymer, a vinyl acetate resin, and a vinyl chloride resin. A butyral resin or the like is particularly preferable. Each of those may be used alone, or two or more types may be used as a mixture or a copolymer.

The charge generation layer can be formed by: subjecting the charge-generating substance to a dispersion treatment together with the binder resin and a solvent; applying the resultant application liquid for the charge generation layer; and drying the applied liquid. A method for the dispersion is, for example, a method involving the use of a homogenizer, an ultrasonic dispersing machine, a ball mill, a sand mill, a roll mill, a vibration mill, an attritor, or a liquid-collision type high-speed dispersing machine. A ratio between the charge-generating substance and the binder resin preferably falls within the range of 1:0.3 to 1:4 (mass ratio).

The solvent used in the application liquid for the charge generation layer is selected in consideration of the solubility and dispersion stability of each of the binder resin and the charge-generating substance to be used. An organic solvent that can be used in the application liquid is, for example, an alcohol, a sulfoxide, a ketone, an ether, an ester, an aliphatic halogenated hydrocarbon, or an aromatic compound. The thickness of the charge generation layer is preferably 5 μm or less, or particularly preferably 0.1 to 2 μm. In addition, any one of the various sensitizers, antioxidants, UV absorbers, and plasticizers can be added to the charge generation layer as required.

Examples of the charge-transporting substance to be used in the charge transport layer include triarylamine-based compounds, hydrazone compounds, stilbene compounds, pyrazoline-based compounds, oxazole-based compounds, triarylmethane-based compounds, and thiazole-based compounds. Each of the charge-transporting substance may be used alone, or two or more types may be used. The charge transport layer has a thickness of preferably 5 to 40 μm, and particularly preferably 10 to 35 μm.

In addition, an antioxidant, a UV absorber, or a plasticizer can be added to the charge transport layer as required. Alternatively, a fluorine atom-containing resin, a silicone-containing resin, or the like may be incorporated into the layer. Alternatively, the layer may contain fine particles each formed of any such resin. Alternatively, the layer may contain metal oxide fine particles or inorganic fine particles. It should be noted that, when the charge transport layer is used as the surface layer of the electrophotographic photosensitive member, any one of those described above may be incorporated into the layer to such an extent that the positions of the triboelectric series of the layer are not affected.

Examples of the application method which may be used in applying the application liquid for the above respective layers include a dip-applying method (dip-coating method), a spray coating method, a spinner coating method, a roller coating method, a Meyer bar coating method, and a blade coating method.

The process cartridge of the present invention includes: the electrophotographic photosensitive member of the present invention; and at least one device selected from the group consisting of a charging device that charges the electrophotographic photosensitive member, a developing device that develops an electrostatic latent image formed on the electrophotographic photosensitive member with toner to form a toner image, and a cleaning device that recovers the toner remaining on the electrophotographic photosensitive member after transfer of the toner image onto a transfer material, in which the process cartridge integrally supports the electrophotographic photosensitive member and the at least one device, and is detachable from a main body of an electrophotographic apparatus.

The electrophotographic apparatus of the present invention includes: the electrophotographic photosensitive member of the present invention; a charging device that charges the electrophotographic photosensitive member; an exposing device that exposes the charged electrophotographic photosensitive member to light to form an electrostatic latent image on the electrophotographic photosensitive member; a developing device that develops the electrostatic latent image formed on the electrophotographic photosensitive member with toner to form a toner image; and a transferring device that transfers the toner image on the electrophotographic photosensitive member onto a transfer material.

Next, FIG. 1 illustrates an example of the outline constitution of an electrophotographic apparatus including a process cartridge having the electrophotographic photosensitive member of the present invention.

In FIG. 1, a drum-shaped electrophotographic photosensitive member 1 is rotated around a shaft 2 in the direction indicated by an arrow at a predetermined circumferential speed. The circumferential surface of the electrophotographic photosensitive member 1 thus rotated is uniformly charged to a predetermined negative potential by a charging device 3 (primary charging device), and then receives exposure light (image exposure light) 4 output from an exposing device (not illustrated) such as slit exposure or laser beam scanning exposure. Thus, electrostatic latent images corresponding to a target image are sequentially formed on the circumferential surface of the electrophotographic photosensitive member 1. A voltage applied to the charging device 3 may be a voltage obtained by superimposing an AC component on a DC component, or may be a voltage formed only of a DC component; only a DC component was applied to the charging device used in the present invention.

The electrostatic latent images formed on the circumferential surface (surface) of the electrophotographic photosensitive member 1 are each developed with toner from a developing device 5 to serve as a toner image. Next, the toner images formed on and carried by the circumferential surface of the electrophotographic photosensitive member 1 are sequentially transferred by a transferring bias from a transferring device 6 (transfer roller). A transfer material P (such as paper) is taken out of a transfer material-feeding device (not illustrated) to be fed to a portion between the electrophotographic photosensitive member 1 and the transferring device 6 (abutting portion) in synchronization with the rotation of the electrophotographic photosensitive member 1. The transfer material P onto which the toner images have been transferred is separated from the circumferential surface of the electrophotographic photosensitive member 1, and is then introduced into a fixing device 8 to undergo image fixation. As a result, the transfer material as an image-formed product (a print or copy) is printed out of the apparatus.

A transfer residual developer (toner) is removed from the surface of the electrophotographic photosensitive member 1 after the transfer of the toner images by a cleaning device 7 (cleaning blade) so that the surface may be cleaned. Further, the surface is subjected to an antistatic treatment by pre-exposure light 11 from a pre-exposing device (not illustrated) before the electrophotographic photosensitive member is repeatedly used for image formation. It should be noted that, for example, a transferring device based on an intermediate transfer system using a belt- or drum-shaped intermediate transfer body may be adopted as the transferring device.

In FIG. 1, the electrophotographic photosensitive member 1, the charging device 3, the developing device 5, and the cleaning device 7 are integrally supported to serve as a process cartridge 9 detachable from the main body of the electrophotographic apparatus with the aid of a guide 10 such as a rail of the main body of the electrophotographic apparatus.

Hereinafter, the present invention is described specifically by way of examples. However, the present invention is not limited to those examples. It should be noted that the term "part(s)" in the following description refers to "part(s) by mass."

Production Example 1

Polyolefin Resin O-1

First, 75 parts of a polyolefin resin (BONDINE HX-8290, manufactured by Sumitomo Chemical Company, Limited), 90 parts of isopropanol, 1.2 equivalents of triethylamine with respect to the carboxyl groups of maleic anhydride in the resin, and 200 parts of distilled water were loaded into a sealable, pressure-resistant glass container provided with a heater and a stirring machine and having a volume of one liter, and the mixture was stirred with the stirring machine while the rotational speed of a stirring blade was set to 300 rpm. As a result, no granular resin precipitate was observed at the bottom of the container, but the resin was observed to be in a floating state. Here, 15 minutes after the observation, the heater was turned on to heat the mixture while the state was maintained. Then, the mixture was stirred for an additional 60 minutes while the temperature in the system was kept at 145° C. After that, the system was immersed in a water bath, and the temperature in the system was cooled to room temperature (a temperature of about 25° C.) while the mixture was stirred with the rotational speed kept at 300 rpm. After that, the mixture was filtrated with a 300-mesh stainless filter (wire diameter 0.035 mm, plain weave) under pressure (at an air pressure of 0.2 MPa). As a result, an opaque, uniform polyolefin resin aqueous dispersion having a solid concentration of 20 mass % was obtained.

The polyolefin resin O-1 was formed of the repeating structural unit (A1) obtained by copolymerizing ethylene, the repeating structural unit (A2) obtained by copolymerizing maleic anhydride, and the repeating structural unit (A3) obtained by copolymerizing ethyl acrylate, and had a ratio "(A1)/(A2)/(A3)" of 80.00/2.00/18.00 (mass %).

EXAMPLE 1

The characteristics of the resin were measured or evaluated by the following methods.

(1) Content of Unit (A2) in Polyolefin Resin

The acid value of the polyolefin resin was measured in conformity with JIS K5407, and the content (graft ratio) of an unsaturated carboxylic acid was determined from the value with the following equation.

Content (mass %) of unit (*A2*)=(mass of grafted unsaturated carboxylic acid)/(mass of raw material polyolefin resin)×100

(2) Constitution of Resin Except Unit (A2)

The content of a component except the unit (A2) was determined by performing $^{1}$H-NMR and $^{13}$C-NMR analysis with an analyzer (manufactured by Varian Technologies Japan Limited, 300 MHz) in o-dichlorobenzene (d4) at 120° C. The $^{13}$C-NMR analysis was performed by employing a gated decoupling method taking quantitativeness into consideration. A method of synthesizing the polyolefin resin is not limited to Production Example 1, and the resin can be synthesized by employing any one of the known methods described in, for example, chapters 1 to 4 of "New Polymer Experiment 2 Synthesis and Reaction of Polymer (1)" (Kyoritsu Shuppan Co., Ltd.), Japanese Patent Application Laid-Open No. 2003-105145, and Japanese Patent Application Laid-Open No. 2003-147028.

First, 60.0 parts of the polyolefin resin O-1, 30.0 parts of ethanol, 3.9 parts of N,N-dimethylethanolamine, and 206.1 parts of distilled water were loaded into a sealable, pressure-resistant glass container provided with a stirring machine and a heater and having a volume of one liter. Next, the resultant mixture was stirred while the rotational speed of the stirring blade of the stirring machine was set to 300 rpm. As a result, no granular resin precipitate was observed at the bottom of the container, but the resin was observed to be in a floating state. Here, 10 minutes after the observation, the heater was turned on to heat the mixture while the state was maintained. Then, the mixture was stirred for an additional 20 minutes while the temperature in the system was kept at 140° C. After that, the system was immersed in a water bath, and the temperature in the system was cooled to room temperature (a temperature of about 25° C.) while the mixture was stirred with the rotational speed kept at 300 rpm. After that, the mixture was filtrated with a 300-mesh stainless filter (wire diameter 0.035 mm, plain weave) under pressure (at an air pressure of 0.2 MPa). As a result, an opaque, uniform polyolefin resin aqueous dispersion was obtained.

Next, 80 parts of $TiO_2$ particles coated with oxygen defective $SnO_2$ (powder resistivity 100 Ω·cm, $SnO_2$ coverage (mass ratio) 35%), 15 parts of methanol as a solvent, and 15 parts of methoxypropanol were subjected to a dispersion treatment with a sand mill using glass beads each having a diameter of 1 mm for 3 hours. As a result, a dispersion liquid was prepared. The average particle diameter of the $TiO_2$ particles coated with oxygen defective $SnO_2$ in the dispersion liquid was 0.30 μm. Then, 3.9 parts of silicone resin particles as a surface roughness-imparting agent (trade name: Tospearl 120, manufactured by Momentive Performance Materials Inc., average particle diameter 2.0 μm) and 0.001 part of silicone oil as a leveling agent (trade name: SH28PA, manufactured by Dow Corning Toray Co., Ltd.) were added to the dispersion liquid, and the mixture was stirred. As a result, a conductive particle dispersion liquid was prepared. Next, 145 parts of the above polyolefin resin aqueous dispersion and 110 parts of the conductive particle dispersion liquid were sufficiently stirred in a container. As a result, an application liquid for the conductive layer of an electrophotographic photosensitive member was prepared.

An aluminum cylinder (JIS-A3003, aluminum alloy) having a length of 260.5 mm and a diameter of 30 mm produced by extrusion and drawing steps was prepared as the support of the electrophotographic photosensitive member. The above application liquid for the conductive layer was applied onto the support by dip coating, and was then dried for 10 minutes at 100° C. As a result, a conductive layer having a thickness of 30 μm was formed. It should be noted that the application was performed so that the application end of the conductive layer might be closer to the end of the support than the end of each of an intermediate layer, a charge generation layer, and a charge transport layer to be described later in order that the peeling of the conductive layer to be described later could be observed. The analysis of the composition of the polyolefin copolymer in the conductive layer formed as described above confirmed that the copolymer had the same mass composition ratio as that of the polyolefin resin raw materials according to the units (A1), (A2), and (A3) before the production of the polyolefin resin aqueous dispersion.

Next, 4.5 parts of N-methoxymethylated nylon (trade name: Toresin EF-30T, manufactured by Nagase ChemteX Corporation) and 1.5 parts of a copolymer nylon resin (AMILAN CM8000, manufactured by Toray Industries, Inc.) were dissolved in a mixed solvent of 65 parts of methanol and 30 parts of n-butanol. The resultant application liquid for an intermediate layer was applied onto the conductive layer by dip coating, and was then dried for 10 minutes at 100° C. As a result, an intermediate layer having a thickness of 0.8 μm was formed.

Next, 10 parts of crystalline hydroxygallium phthalocyanine having a strong peak at a Bragg angle (2θ±0.2°) in CuKα characteristic X-ray diffraction of each of 7.5°, 9.9°, 16.3°, 18.6°, 25.1°, and 28.3° were prepared. The crystal was mixed with 5 parts of polyvinyl butyral (trade name: S-Lec BX-1, manufactured by SEKISUI CHEMICAL CO., LTD.) and 250 parts of cyclohexanone, and the mixture was subjected to a dispersion treatment with a sand mill apparatus using glass beads each having a diameter of 1 mm for 1 hour. Next, 250 parts of ethyl acetate were added to the resultant dispersion liquid. As a result, an application liquid for a charge generation layer was prepared. The application liquid for a charge generation layer was applied onto the intermediate layer by dip coating, and was then dried for 10 minutes at 100° C. As a result, a charge generation layer having a thickness of 0.16 μm was formed.

Next, 8 parts of an amine compound having a structure represented by the following structural formula (1), 1 part of an amine compound having a structure represented by the following structural formula (2), and 10 parts of a polyarylate resin (Mw: 110,000) having a repeating structural unit represented by the following structural formula (3) were dissolved in a mixed solvent containing monochlorobenzene and dimethoxymethane at a final mass ratio of 7:3. As a result, an application liquid for a charge transport layer was prepared. The application liquid for a charge transport layer was applied onto the above charge generation layer by dip coating, and was then dried for 1 hour at 120° C. As a result, a charge transport layer having a thickness of 18 μm was formed. Thus, an electrophotographic photosensitive member using the charge transport layer as its surface layer was produced.

(1)

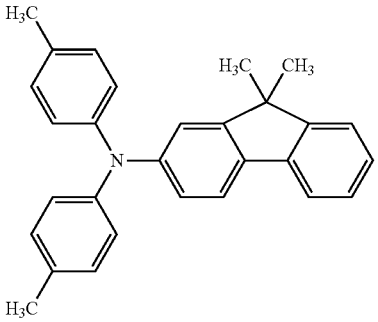

(2)

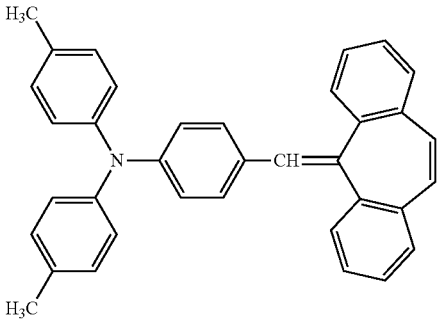

(3)

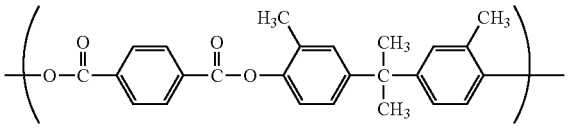

The produced electrophotographic photosensitive member was mounted on a LaserJet 4700 manufactured by Hewlett-Packard Company under an environment having a temperature of 15° C. and a humidity of 10% RH, and image evaluation was performed at an initial stage, and at time points after 5,000-sheet passing duration and after 10,000-sheet passing duration.

To be specific, the evaluation was performed by: mounting the produced electrophotographic photosensitive member on a process cartridge for a cyan color; and mounting the cyan process cartridge on its station. In addition, an abutting roller was provided for the process cartridge so as to abut the end of the electrophotographic photosensitive member for controlling a distance between the developing roller of the process cartridge and the electrophotographic photosensitive member; the process cartridge was reconstructed so that the abutting roller might contact the end of the conductive layer.

At the time of paper passing, character images formed of colors each having a print percentage of 2% were output on 5,000 sheets, or 10,000 sheets, of letter paper by performing a full-color print operation according to the following intermittent mode: an image was output on one sheet every 20 seconds. Then, samples for image evaluation (one-dot, knight-jump pattern halftone images) were output on five sheets at the time of each of: the initiation of the evaluation; the completion of the passing of 5,000 sheets; and the completion of the passing of 10,000 sheets.

The sample images were classified into ranks A to E depending on their charging stripes. An image belonging to the rank A is free of charging stripes, and charging stripes become more remarkable sequentially in the alphabetical order like B, C, . . . . An image belonging to the rank E is such that a significantly large number of charging stripes arise. Images belonging to the ranks A, B, and C are at such levels as to cause no problems in practical use.

The conductive layer was separately evaluated. After the conductive layer had been provided, the surface of the conductive layer was observed with an optical microscope (at a magnification of 1,000), and any one of the ranks A, B, C, and D was given to the conductive layer depending on the presence or absence of cracks in the layer. The conductive layer belonging to the rank A is an extremely good film showing no cracks. The conductive layer belonging to the rank B is at such a level as to cause no problems, though dot-like depressed portions are observed in part of the film. The conductive layer belonging to the rank C has dot-like depressed portions on its entire surface, and the conductive layer belonging to the rank D is such that cracks are generated on the entire surface of the film.

With regard to the peeling of the conductive layer, whether the application end of the conductive layer peeled was observed after the completion of the above 10,000-sheet duration. A rank A is such that no peeling occurs. A rank B is at such a level as to cause no problems, though slight peeling occurs. A rank C is such that peeling occurs.

EXAMPLE 2

An electrophotographic photosensitive member was produced in the same manner as in Example 1 except that the polyolefin resin used in the conductive layer in Example 1 was changed to a polyolefin resin O-2. The resin O-2 was formed of the repeating structural unit (A1) obtained by copolymerizing ethylene, the repeating structural unit (A2) obtained by copolymerizing maleic anhydride, and the repeating structural unit (A3) obtained by copolymerizing ethyl methacrylate, and had a ratio "(A1)/(A2)/(A3)" of 80.00/2.00/18.00 (mass %). The electrophotographic photosensitive member was evaluated in the same manner as in Example 1.

EXAMPLE 3

An electrophotographic photosensitive member was produced in the same manner as in Example 1 except that the polyolefin resin used in the conductive layer in Example 1 was changed to a polyolefin resin O-3. The resin O-3 was formed of the repeating structural unit (A1) obtained by copolymerizing ethylene, the repeating structural unit (A2) obtained by copolymerizing maleic anhydride, and the repeating structural unit (A3) obtained by copolymerizing ethyl acrylate, and had a ratio "(A1)/(A2)/(A3)" of 91:99/

0.01/8.00 (mass %). The electrophotographic photosensitive member was evaluated in the same manner as in Example 1.

EXAMPLE 4

An electrophotographic photosensitive member was produced in the same manner as in Example 1 except that the polyolefin resin used in the conductive layer in Example 1 was changed to a polyolefin resin O-4. The resin O-4 was formed of the repeating structural unit (A1) obtained by copolymerizing ethylene, the repeating structural unit (A2) obtained by copolymerizing maleic anhydride, and the repeating structural unit (A3) obtained by copolymerizing ethyl acrylate, and had a ratio "(A1)/(A2)/(A3)" of 90.00/5.00/5.00 (mass %). The electrophotographic photosensitive member was evaluated in the same manner as in Example 1.

EXAMPLE 5

An electrophotographic photosensitive member was produced in the same manner as in Example 1 except that the polyolefin resin used in the conductive layer in Example 1 was changed to a polyolefin resin O-5. The resin O-5 was formed of the repeating structural unit (A1) obtained by copolymerizing ethylene, the repeating structural unit (A2) obtained by copolymerizing maleic anhydride, and the repeating structural unit (A3) obtained by copolymerizing diethyl maleate, and had a ratio "(A1)/(A2)/(A3)" of 80.00/2.00/18.00 (mass %). The electrophotographic photosensitive member was evaluated in the same manner as in Example 1.

EXAMPLE 6

An electrophotographic photosensitive member was produced in the same manner as in Example 1 except that the polyolefin resin used in the conductive layer in Example 1 was changed to a polyolefin resin O-6. The resin O-6 was formed of the repeating structural unit (A1) obtained by copolymerizing ethylene, the repeating structural unit (A2) obtained by copolymerizing maleic anhydride, and the repeating structural unit (A3) obtained by copolymerizing acrylic acid amide, and had a ratio "(A1)/(A2)/(A3)" of 80.00/2.00/18.00 (mass %). The electrophotographic photosensitive member was evaluated in the same manner as in Example 1.

EXAMPLE 7

An electrophotographic photosensitive member was produced in the same manner as in Example 1 except that the polyolefin resin used in the conductive layer in Example 1 was changed to a polyolefin resin O-7. The resin O-7 was formed of the repeating structural unit (A1) obtained by copolymerizing ethylene, the repeating structural unit (A2) obtained by copolymerizing maleic anhydride, and the repeating structural unit (A3) obtained by copolymerizing vinyl ethyl ether, and had a ratio "(A1)/(A2)/(A3)" of 80.00/2.00/18.00 (mass %). The electrophotographic photosensitive member was evaluated in the same manner as in Example 1.

EXAMPLE 8

An electrophotographic photosensitive member was produced in the same manner as in Example 1 except that the polyolefin resin used in the conductive layer in Example 1 was changed to a polyolefin resin O-8. The resin O-8 was formed of the repeating structural unit (A1) obtained by copolymerizing ethylene, the repeating structural unit (A2) obtained by copolymerizing acrylic acid, and the repeating structural unit (A3) obtained by copolymerizing ethyl acrylate, and had a ratio "(A1)/(A2)/(A3)" of 80.00/2.00/18.00 (mass %). The electrophotographic photosensitive member was evaluated in the same manner as in Example 1.

EXAMPLE 9

An electrophotographic photosensitive member was produced in the same manner as in Example 1 except that the polyolefin resin used in the conductive layer in Example 1 was changed to a polyolefin resin O-9. The resin O-9 was formed of the repeating structural unit (A1) obtained by copolymerizing butene, the repeating structural unit (A2) obtained by copolymerizing maleic anhydride, and the repeating structural unit (A3) obtained by copolymerizing ethyl acrylate, and had a ratio "(A1)/(A2)/(A3)" of 80.00/2.00/18.00 (mass %). The electrophotographic photosensitive member was evaluated in the same manner as in Example 1.

EXAMPLE 10

An electrophotographic photosensitive member was produced in the same manner as in Example 1 except that the polyolefin resin used in the conductive layer in Example 1 was changed to a polyolefin resin O-10. The resin O-10 was formed of the repeating structural unit (A1) obtained by copolymerizing ethylene, the repeating structural unit (A2) obtained by copolymerizing maleic anhydride, and the repeating structural unit (A3) obtained by copolymerizing ethyl acrylate, and had a ratio "(A1)/(A2)/(A3)" of 80.00/10.00/10.00 (mass %). The electrophotographic photosensitive member was evaluated in the same manner as in Example 1.

EXAMPLE 11

An electrophotographic photosensitive member was produced in the same manner as in Example 1 except that the polyolefin resin used in the conductive layer in Example 1 was changed to a polyolefin resin O-11. The resin O-11 was formed of the repeating structural unit (A1) obtained by copolymerizing ethylene, the repeating structural unit (A2) obtained by copolymerizing maleic anhydride, and the repeating structural unit (A3) obtained by copolymerizing ethyl acrylate, and had a ratio "(A1)/(A2)/(A3)" of 49.50/10.00/40.50 (mass %). The electrophotographic photosensitive member was evaluated in the same manner as in Example 1.

EXAMPLE 12

An electrophotographic photosensitive member was produced in the same manner as in Example 1 except that the polyolefin resin used in the conductive layer in Example 1 was changed to a polyolefin resin O-12. The resin O-12 was formed of the repeating structural unit (A1) obtained by copolymerizing ethylene, the repeating structural unit (A2) obtained by copolymerizing maleic anhydride, and the repeating structural unit (A3) obtained by copolymerizing ethyl acrylate, and had a ratio "(A1)/(A2)/(A3)" of 89.10/10.00/0.90 (mass %). The electrophotographic photosensitive member was evaluated in the same manner as in Example 1.

EXAMPLE 13

An electrophotographic photosensitive member was produced in the same manner as in Example 1 except that the polyolefin resin used in the conductive layer in Example 1 was changed to a polyolefin resin O-13. The resin O-13 was formed of the repeating structural unit (A1) obtained by copolymerizing ethylene, the repeating structural unit (A2) obtained by copolymerizing maleic anhydride, and the repeating structural unit (A3) obtained by copolymerizing ethyl acrylate, and had a ratio "(A1)/(A2)/(A3)" of 43.00/10.00/47.00 (mass %). The electrophotographic photosensitive member was evaluated in the same manner as in Example 1.

EXAMPLE 14

An electrophotographic photosensitive member was produced in the same manner as in Example 1 except that the polyolefin resin used in the conductive layer in Example 1 was changed to a polyolefin resin O-14. The resin O-14 was formed of the repeating structural unit (A1) obtained by copolymerizing ethylene, the repeating structural unit (A2) obtained by copolymerizing maleic anhydride, and the repeating structural unit (A3) obtained by copolymerizing ethyl acrylate, and had a ratio "(A1)/(A2)/(A3)" of 89.20/10.00/0.80 (mass %). The electrophotographic photosensitive member was evaluated in the same manner as in Example 1.

EXAMPLE 15

An electrophotographic photosensitive member was produced in the same manner as in Example 1 except that the polyolefin resin used in the conductive layer in Example 1 was changed to a polyolefin resin O-15. The resin O-15 was formed of the repeating structural unit (A1) obtained by copolymerizing ethylene, the repeating structural unit (A2) obtained by copolymerizing maleic anhydride, and the repeating structural unit (A3) obtained by copolymerizing ethyl acrylate, and had a ratio "(A1)/(A2)/(A3)" of 81.00/15.00/4.00 (mass %). The electrophotographic photosensitive member was evaluated in the same manner as in Example 1.

EXAMPLE 16

An electrophotographic photosensitive member was produced in the same manner as in Example 1 except that the polyolefin resin used in the conductive layer in Example 1 was changed to a polyolefin resin O-16. The resin O-16 was formed of the repeating structural unit (A1) obtained by copolymerizing ethylene, the repeating structural unit (A2) obtained by copolymerizing maleic anhydride, and the repeating structural unit (A3) obtained by copolymerizing ethyl acrylate, and had a ratio "(A1)/(A2)/(A3)" of 65.00/30.00/5.00 (mass %). The electrophotographic photosensitive member was evaluated in the same manner as in Example 1.

EXAMPLE 17

An electrophotographic photosensitive member was produced in the same manner as in Example 1 except that a conductive layer was formed as described below in Example 1, and the electrophotographic photosensitive member was evaluated in the same manner as in Example 1. First, 100 parts of the polyolefin resin aqueous dispersion O-1, 110 parts of the conductive particle dispersion liquid, and 17 parts of a phenol resin (trade name: Plyophen J-325, manufactured by DIC Corporation, methanol solution, resin solid content 60%) were stirred in a container for 1 hour. Next, an application liquid for a conductive layer thus obtained was applied onto the support by dip coating, and was then dried at 140° C. for 30 minutes. As a result, a conductive layer having a thickness of 30 μm was formed.

EXAMPLE 18

An electrophotographic photosensitive member was produced in the same manner as in Example 1 except that particles obtained by subjecting anatase type $TiO_2$ surface-treated with vinyltriethoxysilane to a dispersion treatment (particle diameter after the dispersion 0.28 μm) were used as conductive particles in Example 1. The electrophotographic photosensitive member was evaluated in the same manner as in Example 1.

COMPARATIVE EXAMPLE 1

An electrophotographic photosensitive member was produced in the same manner as in Example 1 except that the polyolefin resin used in the conductive layer in Example 1 was changed to a polyolefin resin O-17. The resin O-17 was formed of the repeating structural unit (A1) obtained by copolymerizing ethylene, the repeating structural unit (A2) obtained by copolymerizing maleic anhydride, and the repeating structural unit (A3) obtained by copolymerizing ethyl acrylate, and had a ratio "(A1)/(A2)/(A3)" of 62.00/33.00/5.00 (mass %). The electrophotographic photosensitive member was evaluated in the same manner as in Example 1.

COMPARATIVE EXAMPLE 2

An electrophotographic photosensitive member was produced in the same manner as in Example 1 except that the polyolefin resin used in the conductive layer in Example 1 was changed to a polyolefin resin O-18. The resin O-18 was formed of the repeating structural unit (A1) obtained by copolymerizing ethylene, and the repeating structural unit (A3) obtained by copolymerizing ethyl acrylate, and had a ratio "(A1)/(A3)" of 91.00/9.00 (mass %). The electrophotographic photosensitive member Was evaluated in the same manner as in Example 1.

COMPARATIVE EXAMPLE 3

An electrophotographic photosensitive member was produced in the same manner as in Example 1 except that a conductive layer was formed as described below without the use of any polyolefin resin aqueous dispersion in Example 1, and the electrophotographic photosensitive member was evaluated in the same manner as in Example 1. First, 110 parts of the conductive particle dispersion liquid were mixed with 30 parts of a melamine resin and 30 parts of methanol, and the mixture was stirred for 1 hour. Next, an application liquid for a conductive layer thus obtained was applied onto the support by dip coating, and was then dried at 140° C. for 30 minutes. As a result, a conductive layer having a thickness of 30 μm was formed.

TABLE 1-1

| Metal oxide for conductive layer | | Resin for conductive layer | Characteristics of conductive | | Image characteristics (charging stripes) | | |
|---|---|---|---|---|---|---|---|
| | | | Peeling | Crack | Initial stage | After 5,000-sheet duration | After 10,000-sheet duration |
| Example 1 | $TiO_2$ coated with $SnO_2$ | O-1 | A | A | A | A | A |
| Example 2 | $TiO_2$ coated with $SnO_2$ | O-2 | A | A | A | A | A |
| Example 3 | $TiO_2$ coated with $SnO_2$ | O-3 | A | A | A | A | A |
| Example 4 | $TiO_2$ coated with $SnO_2$ | O-4 | A | A | A | A | A |
| Example 5 | $TiO_2$ coated with $SnO_2$ | O-5 | B | A | A | A | A |
| Example 6 | $TiO_2$ coated with $SnO_2$ | O-6 | B | A | A | A | A |
| Example 7 | $TiO_2$ coated with $SnO_2$ | O-7 | B | A | A | A | A |
| Example 8 | $TiO_2$ coated with $SnO_2$ | O-8 | B | A | A | A | A |
| Example 9 | $TiO_2$ coated with $SnO_2$ | O-9 | B | A | A | A | A |
| Example 10 | $TiO_2$ coated with $SnO_2$ | O-10 | B | A | A | A | B |
| Example 11 | $TiO_2$ coated with $SnO_2$ | O-11 | B | A | A | A | B |
| Example 12 | $TiO_2$ coated with $SnO_2$ | O-12 | B | A | A | A | B |
| Example 13 | $TiO_2$ coated with $SnO_2$ | O-13 | B | A | A | B | B |
| Example 14 | $TiO_2$ coated with $SnO_2$ | O-14 | B | A | A | B | B |
| Example 15 | $TiO_2$ coated with $SnO_2$ | O-15 | B | A | A | B | B |
| Example 16 | $TiO_2$ coated with $SnO_2$ | O-16 | B | A | A | B | B |
| Example 17 | $TiO_2$ coated with $SnO_2$ | O-1 Phenol resin | A | B | A | B | B |
| Example 18 | $TiO_2$ (surface-treated) | O-1 | A | A | A | A | A |

TABLE 1-2

| Metal oxide for conductive layer | | Resin for conductive layer | Characteristics of conductive | | Image characteristics (charging stripes) | | |
|---|---|---|---|---|---|---|---|
| | | | Peeling | Crack | Initial stage | After 5,000-sheet duration | After 10,000-sheet duration |
| Comparative Example 1 | $TiO_2$ coated with $SnO_2$ | O-17 | A | A | C | D | E |
| Comparative Example 2 | $TiO_2$ coated with $SnO_2$ | O-18 | C | C | A | A | A |
| Comparative Example 3 | $TiO_2$ coated with $SnO_2$ | Melamine resin | A | D | B | B | C |

While the present invention has been described with reference to exemplary embodiments, it is to be understood that the invention is not limited to the disclosed exemplary embodiments. The scope of the following claims is to be accorded the broadest interpretation so as to encompass all such modifications and, equivalent structures and functions.

This application claims the benefit of Japanese Patent Application No. 2009-252119, filed Nov. 2, 2009 which is hereby incorporated by reference herein in its entirety.

What is claimed is:

1. An electrophotographic photosensitive member, comprising:

a conductive support;

a conductive layer containing conductive particles having a volume-average particle diameter of 0.1 μm or more;

an intermediate layer; and a photosensitive layer, the conductive layer, the intermediate layer, and the photosensitive layer being provided on the conductive support in the stated order, wherein the conductive layer contains a polyolefin resin having the following repeating structural units (A1), (A2), and (A3), and a mass ratio (%) of the units (A1), (A2), and (A3) in the polyolefin resin satisfies the following formula (1), and wherein the units (A1), (A2), and (A3) are the only repeating structural units in the polyolefin resin:

$$0.01 \leqq (A2)/\{(A1)+(A2)+(A3)\} \times 100 \leqq 30 \qquad \text{Formula (1)}$$

(A1): a repeating structural unit represented by the following formula (11):

(11)

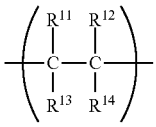

where $R^{11}$ to $R^{14}$ each independently represent a hydrogen atom or an alkyl group;

(A2): a repeating structural unit represented by the following formula (22):

(22)

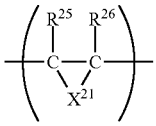

where $R^{25}$ and $R^{26}$ each independently represent a hydrogen atom, an alkyl group, or a phenyl group, and $X^{21}$ represents a divalent group represented by $-Y^{22}COO-COY^{23}-$ where $Y^{22}$ and $Y^{23}$ each independently represent a single bond, an alkylene group, or an arylene group; and (A3): a repeating structural unit represented by any one of the following formulae (31), (32), (33), and (34):

(31)

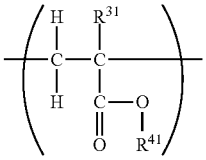

(32)

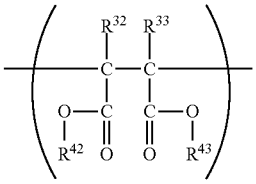

(33)

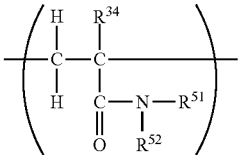

(34)

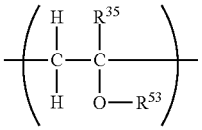

where $R^{31}$ to $R^{35}$ each independently represent a hydrogen atom or a methyl group, $R^{41}$ to $R^{43}$ each independently represent an alkyl group having 1 to 10 carbon atoms, and $R^{51}$ to $R^{53}$ each independently represent a hydrogen atom or an alkyl group having 1 to 10 carbon atoms.

2. An electrophotographic photosensitive member according to claim 1, wherein the mass ratio (%) of the units (A1), (A2), and (A3) in the polyolefin resin satisfies the following formulae (2) and (3):

$$0.01 \leqq (A2)/\{(A1)+(A2)+(A3)\} \times 100 \leqq 10 \qquad \text{Formula (2); and}$$

$$(A1)/(A3) = 55/45 \text{ to } 99/1 \qquad \text{Formula (3).}$$

3. An electrophotographic photosensitive member according to claim 1, wherein the mass ratio (%) of the units (A1), (A2), and (A3) in the polyolefin resin satisfies the following formula (4):

$$0.01 \leqq (A2)/\{(A1)+(A2)+(A3)\} \times 100 \leqq 5 \qquad \text{Formula (4).}$$

4. An electrophotographic photosensitive member according to claim 1, wherein the polyolefin resin comprises one of an ethylene-acrylate-maleic anhydride ternary copolymer and an ethylene-methacrylate-maleic anhydride ternary copolymer.

5. A process cartridge, comprising:

the electrophotographic photosensitive member according to claim 1; and at least one device selected from the group consisting of a charging device that charges the electrophotographic photosensitive member, a developing device that develops an electrostatic latent image formed on the electrophotographic photosensitive member with toner to form a toner image, and a cleaning device that recovers the toner remaining on the electrophotographic photosensitive member after transfer of the toner image onto a transfer material, wherein the process cartridge integrally supports the electrophotographic photosensitive member and the at least one device, and is detachable from a main body of an electrophotographic apparatus.

6. An electrophotographic apparatus, comprising:

the electrophotographic photosensitive member according to claim 1;

a charging device that charges the electrophotographic photosensitive member;

an exposing device that exposes the charged electrophotographic photosensitive member to light to form an electrostatic latent image on the electrophotographic photosensitive member;

a developing device that develops the electrostatic latent image formed on the electrophotographic photosensitive member with toner to form a toner image; and a transferring device that transfers the toner image on the electrophotographic photosensitive member onto a transfer material.

* * * * *